US008428477B2

(12) United States Patent
Shibata et al.

(10) Patent No.: US 8,428,477 B2
(45) Date of Patent: Apr. 23, 2013

(54) IMAGE FORMING APPARATUS

(75) Inventors: Masahiro Shibata, Numazu (JP); Masahiro Yoshida, Tokyo (JP); Kazunori Hashimoto, Numazu (JP); Kazuhiro Okubo, Meridian, ID (US); Hisashi Yamauchi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 302 days.

(21) Appl. No.: 12/791,412

(22) Filed: Jun. 1, 2010

(65) Prior Publication Data

US 2010/0303486 A1 Dec. 2, 2010

(30) Foreign Application Priority Data

Jun. 1, 2009 (JP) ..... 2009-132042
Apr. 14, 2010 (JP) ..... 2010-093017

(51) Int. Cl.
*G03G 15/00* (2006.01)

(52) U.S. Cl.
USPC ..... 399/43; 399/38; 399/128; 399/168

(58) Field of Classification Search ..... 399/38, 399/50, 43, 128, 168
See application file for complete search history.

(56) References Cited

U.S. PATENT DOCUMENTS

| | | | | |
|---|---|---|---|---|
| 6,064,847 | A * | 5/2000 | Iwamatsu et al. | 399/283 |
| 6,163,663 | A | 12/2000 | Shinohara et al. | |
| 6,751,423 | B2 | 6/2004 | Sakaizawa et al. | |
| 7,006,774 | B2 | 2/2006 | Saito et al. | |
| 7,050,733 | B2 | 5/2006 | Saito et al. | |
| 7,092,662 | B2 * | 8/2006 | Yamamura | 399/285 |
| 7,254,350 | B2 | 8/2007 | Kawamura et al. | |
| 7,269,382 | B2 | 9/2007 | Hashimoto | |
| 7,403,726 | B2 | 7/2008 | Shibata | |
| 7,580,654 | B2 | 8/2009 | Okubo | |
| 2001/0026694 | A1 * | 10/2001 | Sakaizawa et al. | 399/50 |
| 2010/0196030 | A1 | 8/2010 | Okubo et al. | |

FOREIGN PATENT DOCUMENTS

| | | |
|---|---|---|
| JP | 5-100563 | 4/1993 |
| JP | 6-95481 | 4/1994 |

* cited by examiner

*Primary Examiner* — Walter L Lindsay, Jr.
*Assistant Examiner* — Roy Y Yi
(74) *Attorney, Agent, or Firm* — Fitzpatrick, Cella, Harper & Scinto

(57) ABSTRACT

An image forming apparatus includes a toner carrying member for supplying toner to an image bearing member to visualize the latent image; a rotatable toner supply member, contacted to the toner carrying member, for supplying toner to the image bearing member; a voltage applying device for applying voltages to the toner carrying member and the toner supply member; and a controller for controlling the voltage applying device to control voltages applied to the toner carrying member and the toner supplying member.

8 Claims, 7 Drawing Sheets

IMAGE FORMING APPARATUS

FIELD OF THE INVENTION AND RELATED ART

The present invention relates to an image forming apparatus such as an electrophotographic copying machine or an electrophotographic printer.

Heretofore, in the image forming apparatus which utilizes the electrophotographic type process, for example a surface of a photosensitive member as an image bearing member is charged by charging means, thereafter light is projected onto the surface of the photosensitive member to form an electrostatic latent image on the surface of the photosensitive member. The electrostatic latent image is visualized into a toner image with toner as a developer supplied from a developing device. The toner image is transferred onto a recording material such as paper, an OHP sheet, or cloth from the photosensitive member by the transferring means. The deposited matter such as the untransferred toner which remains on the photosensitive member after the transferring is removed by cleaning means, and the photosensitive member is again subjected to a charging step by the charging means. The recording material onto which the toner image is transferred is subjected to the fixing operation with the toner image by fixing means, and thereafter, it is outputted from the image forming apparatus as a print. Generally, the developing methods for visualizing the electrostatic latent image into the toner image are classified into the developing method which uses a one-component developer, and the developing method which uses the two-component developer. As for the developing method which uses the one-component developer, one-component dry-and-contact-type developing method is proposed and put into practical use.

In the one-component dry-and-contact-type developing method, the rotating toner carrying member as the developing roller are pressed or contacted with a proper relative peripheral speed difference, so that the electrostatic latent image is developed. By this, a magnetic material required by the conventional developing method is unnecessary, and therefore the simplification and downsizing of the apparatus are easy. Moreover, when the non-magnetic toner is used, the full color image formation is possible and it has many advantages. In this developing method, as for the toner carrying member, the developing roller having the elasticity and the electro-conductivity is used. In order to carry out the development, it is pressed or contacted to the photosensitive member, and therefore, more particularly, in the case where the photosensitive member is a rigid member, the photosensitive member may be damaged, and in order to avoid this, the developing roller in the form of an elastic member is used. The developing roller is provided with an electroconductive layer, at the surface thereof or adjacent to the surface thereof, and it is supplied with the developing roller bias voltage. Furthermore, for the charge application to the toner and a uniform thin toner layer formation, a developing blade as a toner regulating member can be contacted to the developing roller. A supplying roller is contacted to the developing roller, as a rotatable toner feeding member (toner applying member) for supplying the non-magnetic one-component toner in the developer container to the developing roller. The supplying roller is a sponge roller, and it carries out the supply of the toner to the developing roller and the scraping of the toner which remains on the developing roller. The supplying roller is disposed in an upstream side, with respect to the rotational direction of the developing roller, of the developing blade. The toner supplied to the developing roller by the supplying roller is regulated into a predetermined layer thickness by the developing blade, and thereafter, it is fed to the contact region (developing position) between the developing roller and the surface of the photosensitive member. In the developing position, the toner is transferred toward the portion on the photosensitive member in which the electrostatic latent image is formed by a force of an electric field formed by the developing roller bias voltage supplied from a developing roller bias voltage source to the developing roller at the time of the development. The developing roller bias voltage source applies a predetermined developing roller bias voltage to the developing roller. The predetermined supplying roller bias higher than the developing roller bias voltage is applied also to the supplying roller from a supplying roller bias voltage source.

A supplying roller bias can apply the supply voltage or another voltage to the supplying roller. By applying the voltage to the supplying roller, the voltage for moving the toner toward the supplying roller from the developing roller can be generated. As has been described in the foregoing, using the developing roller bias voltage source and the supplying roller bias voltage source, the voltage is formed between the developing roller and the supplying roller, the supply and the collection of the toner is carried out by the voltage difference formed, and such a method is proposed (Japanese Laid-open Patent Application Hei 05-100563). A control method is proposed in which latent image strength is kept constant and the development is carried out with the stabilized density irrespective of the change of an ambient condition, the deterioration of a photosensitive drum, or the developing device downtime, (Japanese Laid-open Patent Application Hei 06-095481). This method uses a developing roller surface potential sensor for detecting the surface potential of the developing roller and a surface potential sensor for a photosensitive member surface. Mp, in response to detection outputs from both sensors, as has been described in the foregoing, a difference between the potentials is constant, when a potential difference between the developing roller bias voltage and the supplying roller bias is constant However, when the developing roller and the supplying roller are contacted to each other, as disclosed in Japanese Laid-open Patent Application Hei 05-100563 or Japanese Laid-open Patent Application Hei 06-095481, the following problems may arise. In the case that when an image is outputted, after the developing device is kept inactive for a long time, with the OFF-state of the voltage source of the image forming apparatus, the portion having the density unevenness may appear on the image outputted in a cycle of the circumferential length of the supplying roller (cyclic density unevenness image). The cyclic density unevenness image may appear on a solid black image and a halftone image, and the dark position and the thin position appear, as compared with the density of a circumference. For this reason, there is a difference between the image on a display screen and an actual hard copy image, and a user may determine that the image forming apparatus is out of order. In other words the user may be confused. The investigation of the inventor about the cyclic density unevenness image has revealed the following. More particularly in a contact position between the developing roller and the supplying roller, the supplying roller is locally dented by a pressure from the developing roller, and a toner coating amount onto the developing roller may change correspondingly to this recess portion.

SUMMARY OF THE INVENTION

An object of the present invention is to provide an image forming apparatus, wherein even after a developing device is kept inactive for a long time, and the production of a cyclic density unevenness image is suppressed.

According to an aspect of the present invention, there is provided an image forming apparatus, comprising an image bearing member for bearing an image; a toner carrying member for supplying toner to said image bearing member to visualize the latent image; a rotatable toner supply member, contacted to said toner carrying member, for supplying the toner to the toner carrying member, said toner supply member including a surface foam layer; a voltage applying device for applying voltages to said toner carrying member and said toner supply member; a controller for controlling said voltage application apparatus such that A and B have a polarity which is the same as a regular charging polarity of the toner, where $A=Vs2-Vd2$, $B=(Vs2-Vd2)-(Vs1-Vd1)$, Vd1 is a voltage applied to said toner carrying member by said voltage applying device during a period in which the latent image is visualized, Vs1 is a voltage applied to said toner supplying member during the period, vd2 is a voltage applied to said toner carrying member by said voltage applying device during at least a part of a period which is after the visualization of the latent image and before stoppage of rotation of said toner supplying member, and Vs2 is a voltage applied to said toner supplying member during said at least the part of the period.

Figure 4:
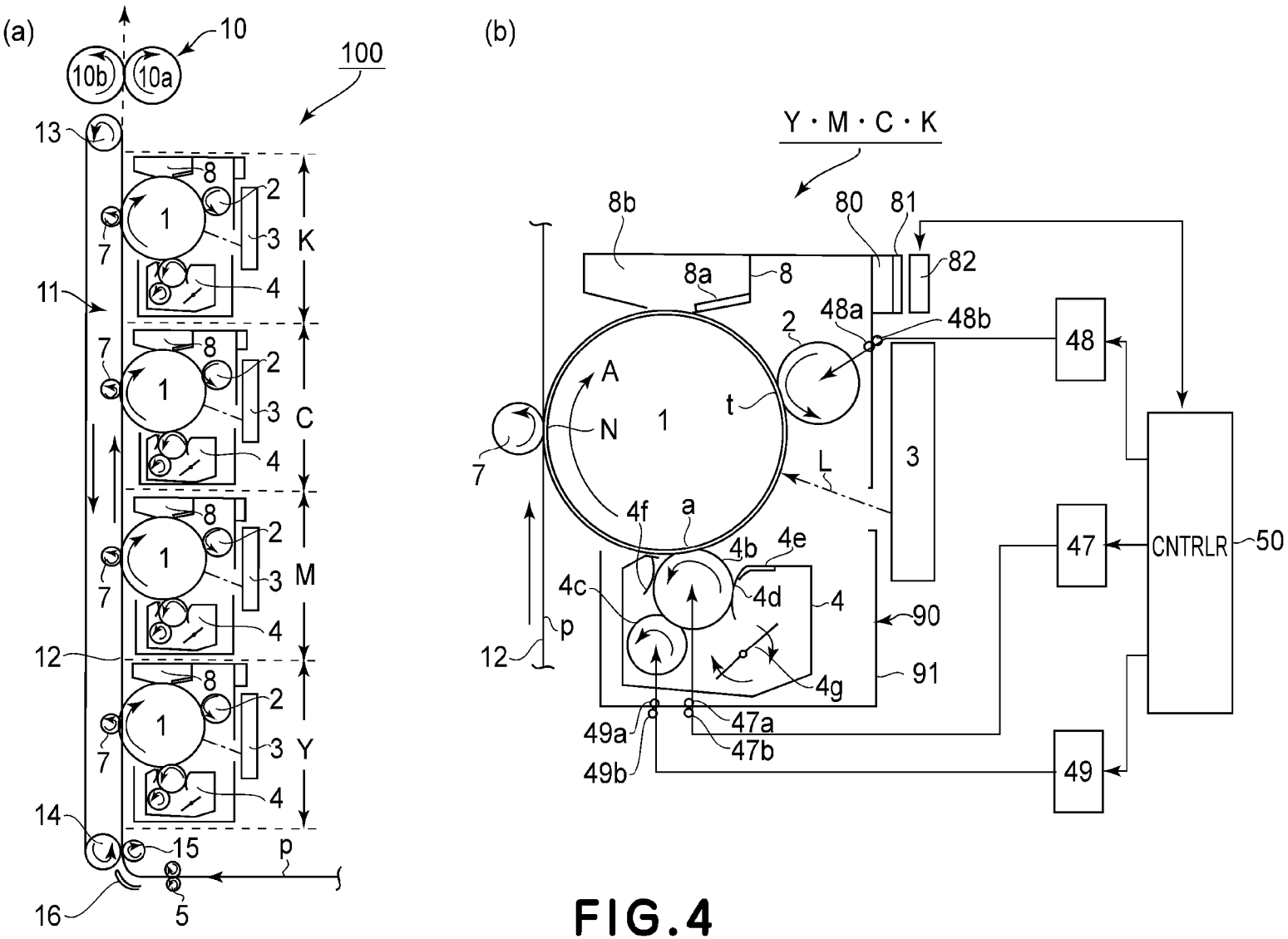

Part (a) of FIG. 4 illustrates the image forming apparatus according to Embodiment 4, and part (b) is an enlarged view of one image formation station portion in the image forming apparatus of (a) of FIG. 4.

DESCRIPTION OF THE PREFERRED EMBODIMENTS

[Embodiment 1]

(1) Description of General Structure of Image Forming Apparatus

Figure 1A:
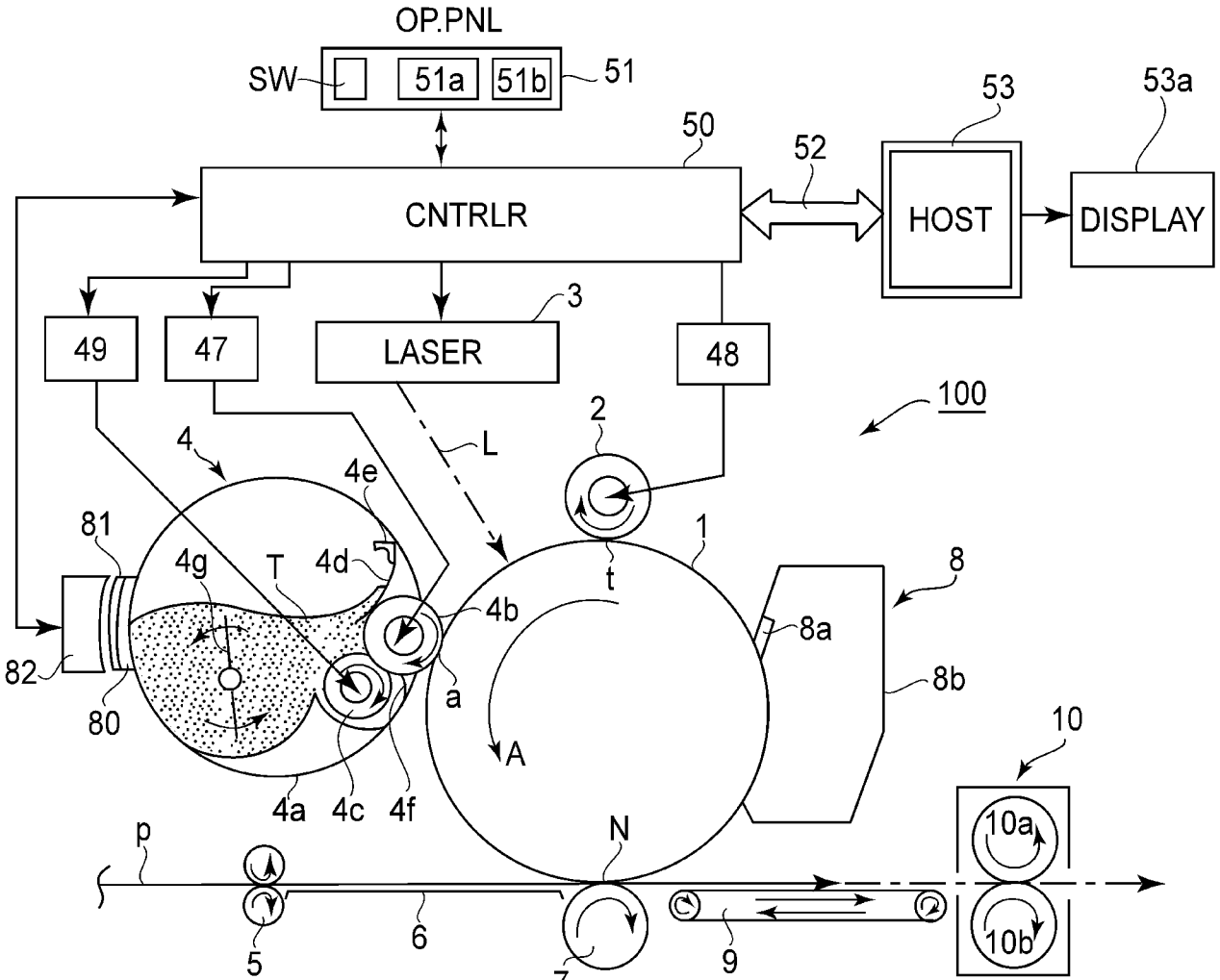
FIG. 1A illustrates an image forming apparatus relating to Embodiment 1 of the present invention.

FIG. 1A is a block diagram of the image forming apparatus in this embodiment, and shows the structure of the essential portions of the image forming apparatus 100, and the control system of the apparatus 100. This apparatus 100 is a laser beam printer which uses an electrophotographic process. Its control portion 50 (controlling means) is in connection with a host apparatus 53 through a connector 52 (interface). The apparatus 100 forms an image on a sheet of recording medium P, based on the image data (electrical information of image) inputted to the control portion 50 from the host apparatus 53. It discharges the sheet of recording medium P after the formation of the image on the sheet of recording medium P. The control portion 50 is a control circuit whose main portion is a microcomputer, for example. It exchanges various information in the form of electrical signals with the host apparatus 53. It processes the information in the form of electrical signals inputted from various processing devices and sensors of the apparatus 100, processes command signals to be sent to various processing devices, and controls a preset initial sequence and a preset image formation sequence, based on control programs, referential tables, etc., stored in the memory portions of the apparatus 100. The host apparatus 53 is a host computer, a network, an image reader, or a facsimile, for example. Designated by a referential code 53*a* is a display of the host apparatus 53. Designated by a referential code 51 is a control panel portion of the image forming apparatus 100. The control panel portion 51 has a main electric power switch SW, a control key group 51*a*, a display 51*b*, etc.

The image forming apparatus 100 has an electrophotographic photosensitive member 1, which is an image bearing member on which a latent image is formed. The electrophotographic photosensitive member 1 is in the form of a drum and is in the main assembly of the apparatus 100. The electrophotographic photosensitive member 1 (which hereafter will be referred to simply as drum 1) is rotatable. The drum 1 in this embodiment is a photoconductive organic member. The drum 1 is rotated at a preset peripheral velocity (process speed) by a motor (unshown) in the counterclockwise direction indicated by an arrow mark A. As the drum 1 is rotated, the peripheral surface of the drum 1 is uniformly charged to preset polarity and potential level by a charging means 2, which is in the form of a roller (charge roller). The charging means 2 in this embodiment is of the so-called contact type. The charge roller 2 has a metallic core, and an electrically conductive elastic layer. The electrically conductive layer is coaxial with the metallic core, and covers the peripheral surface of the metallic core. The charge roller 2 is disposed virtually parallel to the drum 1, and is kept pressed upon the drum 1 so that a preset amount of pressure is maintained between its electrically conductive elastic layer and the drum 1, by the elasticity of its elastic layer. The lengthwise ends of the metallic core of the charge roller 2 are supported by a pair of bearings so that the charge roller 2 can be rotated; the charge roller 2 is rotated by the rotation of the drum 1. In this embodiment, a preset charge bias is applied to the metallic core of the charge roller 2 from a charge bias generation circuit 48, whereby the peripheral surface of the drum 1 is uniformly charged to roughly 500 V (pre-exposure potential level VD). The uniformly charged portion of the peripheral surface of the drum 1 is exposed by a laser scanner unit 3 (exposing means), based on the information of the image to be formed. As a result, an electrostatic latent image, which reflects the information of the image to be formed, is formed on the peripheral surface of the drum 1. In this embodiment, the peripheral surface of the drum 1 is exposed using the following method. The image data inputted into the control portion 50 from the host apparatus 53 are processed by the controlled portion 50 into sequential digital electrical signals, which correspond one for one to picture elements. The digital electrical signals are inputted into the laser scanner 3, which has: a laser beam outputting portion which outputs a beam of laser light L while modulating the beam with the inputted image data; a rotational polygonal mirror (polygon mirror); an f-θ; a reflection mirror; etc. The charged portion of the peripheral surface of the drum 1 is scanned with the beam of laser light L, which is moved in the primary scan direction (direction perpendicular to rotational direction of drum 1). That is, the charged portion of the peripheral surface of the drum 1 is scanned by the beam of laser light L while the drum 1 is rotated in the direction (secondary scan direction) perpendicular to the primary scan direction. As a result, an electrostatic latent image, the pattern of which reflects the image data, is effected on the peripheral surface of the drum 1 as the drum 1 is rotated. More specifically, as a given point on the charged portion of the peripheral surface of the drum 1 is exposed, the potential of this point attenuates to roughly −100 V (post-exposure potential level VL). Thus, an electrostatic image, which reflects the image data, is formed on the peripheral surface of the drum 1 by the contrast between the potential level VD of unexposed points and the potential level DL of exposed points.

The electrostatic latent image is developed into a visible image, that is, an image formed of toner (which hereafter will be referred to as toner image), by a developing apparatus 4 which opposes the drum 1. The developing apparatus 4 in this embodiment is of the so-called contact type, and reversely develops an electrostatic latent image. It uses nonmagnetic and negatively chargeable single-component developer (which hereafter will be referred to as toner T). Thus, the electrostatic latent image on the peripheral surface of the drum 1 is reversely developed; toner is adhered to the exposed points of the charged portion of the peripheral surface of the drum 1. The developing apparatus 4 has a development roller 4*b*, which is a toner bearing member. Toner is borne in a layer on the peripheral surface of the development roller 4*b*, to a preset thickness. In a developing operation, a preset development roller bias is applied to the metallic core of the development roller 4*b* while the development roller 4*b* is rotated. As a result, the electrostatic latent image is developed. The developing apparatus 4 in this embodiment will be described in detail in Section (2) of this document.

Meanwhile, one of the sheets of recording medium P in the recording medium storing-and-feeding portion is separated from the rest, and is fed into the main assembly of the image forming apparatus 100. Then, the sheet of recording medium P (which hereafter will be referred to simply as recording sheet P) is conveyed to a pair of registration rollers 5 which is remaining stationary. As the leading edge of the recording sheet P is caught by the nip between the pair of rollers 5, it is corrected in attitude by the pair of registration rollers 5. Then, the pair of registration rollers 5 are rotated with a preset timing, conveying thereby the recording sheet P further while guiding the recording sheet P by a guiding member 6. Then, the recording sheet P is introduced into a transfer nip N, that is, the interface (area of contact) between the peripheral surface of the drum 1 and the peripheral surface of a transfer roller 7. The transfer roller 7 is a rotational transferring means. It has a metallic core and an electrically conductive elastic layer. The elastic layer is coaxial with the metallic core. It is formed on the peripheral surface of the metallic core in a manner to completely cover the peripheral surface of the metallic core. The transfer roller 7 is disposed roughly in parallel to the drum 1, and is kept in contact with the drum 1 so that a preset amount of pressure is maintained between the peripheral surface of the transfer roller 7 and the peripheral surface of the drum 1 by the resiliency of the elastic layer of the transfer roller 7. The transfer roller 7 forms a transfer nip N between itself and drum 1. The recording sheet P is conveyed through this transfer nip N while remaining pinched between the drum 1 and transfer roller 7. While the recording sheet P is conveyed through the transfer nip N, a transfer bias with a preset potential level is applied to the transfer roller 7 from a transfer bias generation circuit (unshown). The polarity of the transfer bias is opposite to the normal polarity to which the toner T is to be charged (polarity of most of toner particles used for development of electrostatic latent image). The transfer bias applied in this embodiment is positive, and is preset in potential level. As the transfer bias, which is opposite in polarity to the toner T, is applied to the transfer roller 7, an electric charge which is opposite in polarity to the toner is applied to the back surface (surface opposite from surface facing drum 1) of the recording sheet P, in the transfer nip N. Consequently, the toner image on the drum 1 is electrostatically transferred onto the surface of the recording sheet P. After the recording sheet P is moved out of the transfer nip N, it is separated from the peripheral surface of the drum 1, and is introduced by a conveying apparatus 9, into a fixing apparatus 10, which is an image fixing means. In the fixing apparatus 10, the unfixed toner image on the recording sheet P is fixed to the recording sheet P. The fixing apparatus 10 in this embodiment is of the so-called heat roller type. It is made up of a heat roller 10*a* and a pressure roller 10*b*. The heat roller 10*a* is controlled in temperature so that the temperature of its peripheral surface remains at a preset level, or the fixation level. The pressure roller 10*b* is disposed roughly parallel to the heat roller 10*a*, and is kept pressed upon the heat roller 10*a*, forming thereby a fixation nip. The heat roller 10*a* and pressure roller 10*b* are rotated at a preset speed in the directions indicated by a pair of arrow marks, one for one. As the two rollers 10*a* and 10*b* are rotated, the recording sheet P is conveyed through the fixation nip while remaining pinched by the two rollers 10*a* and 10*b*. As the recording sheet P is conveyed through the fixation nip, heat and pressure are applied to the unfixed toner image on the recording sheet P. As a result, the unfixed toner image becomes fixed to the recording sheet P; it becomes a solid and permanent image. After the recording sheet P is conveyed out of the fixing apparatus 10, it is discharged as a permanent copy, that is, the recording sheet P having a fixed toner image, into a delivery tray (unshown). After the separation of the recording sheet P from the peripheral surface of the drum 1, the peripheral surface of the drum 1 is cleaned by a cleaning apparatus 8 as a cleaning means; the residues on the peripheral surface of the drum 1, that is, the toner particles and/or the like which are remaining on the peripheral surface of the drum 1 after the separation of the recording sheet P, are removed by the cleaning apparatus 8, so that the peripheral surface of the drum 1 can be repeatedly used for image formation. The cleaning apparatus 8 in this embodiment has a blade 8*a* as a drum cleaning member, which is placed in contact with the peripheral surface of the drum 1. More specifically, the blade 8*a* is tilted relative to the peripheral surface of the drum 1 at such an angle that its cleaning edge is on the upstream side relative to its base portion in terms of the rotational direction of the drum 1. Moreover, the blade 8*a* is disposed as if its cleaning edge portion were penetrating into the drum 1 by a preset distance. Therefore, as the drum 1 is rotated, the contaminants, such a the above-mentioned transfer residual toner, on the drum 1 are scraped away from the peripheral surface of the drum 1 by the cleaning edge of the blade 8*a*, at the line of contact between the peripheral surface of the drum 1, and the cleaning edge of the blade 8*a*, and are recovered into a waste toner container 8*b*.

(2) Developing Apparatus

The developing apparatus 4 in this embodiment is of the so-called contact type, and reversely develops electrostatic latent images. It uses dry single-component developer (toner). It has a developer container 4*a* (toner storage: toner hopper), which is filled with toner T (negatively chargeable nonmagnetic single-component developer). It has also a development roller 4*b* as a toner bearing member, which is rotatable. The developer container 4*a* is provided with an opening, which faces the drum 1. The development roller 4*b* faces the drum 1 through this opening. The developing apparatus 4 has also a toner supply roller 4*c* (which hereafter will be referred to simply as supply roller 4*c*) as a member for supplying (coating) the development roller 4*b* with the toner T. The supply roller 4*c* is within the develop container 4*a*, and is rotatably disposed roughly in parallel to, and in contact with, the development roller 4*c*. Further, the developing apparatus 4 has a development blade 4*d* as a member for regulating the thickness with which the toner T is coated on the peripheral surface of the development roller 4*b*. The development blade 4*d* extends from one lengthwise end of the development roller 4*b* to the other. It is supported by a blade supporting metallic plate 4*e*, by one of its lengthwise edge portions so that one of the surfaces of the other lengthwise edge portion (free edge portion) is placed in contact with the peripheral surface of the development roller 4*b*. The developing apparatus 4 has also a blow-out prevention sheet 4*f* for preventing toner T from being blown out of the developer container 4*a* through the gap between the development roller 4*b* and the edges of the aforementioned opening of the developer container 4*a*. The blow-out prevention sheet 4*f* is below the development roller 4*b*, and is fixed to the developer container 4*a* by its base portion. Further, the developing apparatus 4 has a rotatable toner conveying member 4*g* (toner stirring-and-conveying member), which is within the developer container 4*a*.

The nonmagnetic toner T, which is negatively chargeable single-component developer, is made up of primarily particles of toner and particles of negatively chargeable additive as auxiliary particles. Ordinarily, the external additive is hydrophobic silica, and is mixed into the particles of toner by an appropriate amount to improve the toner T in chargeability and transferability. The development roller 4*b* is 18 mm in diameter, and is made up of an axle, a substrate layer, and surface layer. The axle is made of stainless steel, and is 8 mm in diameter. The substrate layer covers the peripheral surface of the axle. It is made of a rubbery substance such as urethane rubber, silicone rubber, etc., and is 5 mm in thickness. The surface layer is made of acrylic rubber, urethane rubber, or the like, and is coated on the substrate layer. More specifically, the development roller 4*b* is 50 degrees in hardness (Asker C scale), and $10^4$ Ω·cm-$10^{12}$ Ω·cm in volumetric resistance. The structure and specifications of the development roller 4*b* do not need to be limited to the above described ones. However, because the image forming apparatus 100 in this embodiment uses a developing method of the contact type, and also, uses a nonmagnetic single-component developer, the development roller 4*b* needs to be elastic and electrically conductive. In other words, any roller may be used as the development roller 4*b* as long as it has a proper amount of elasticity and a proper amount of electrical conductivity. The supply roller 4*c* is a urethane sponge roller, which is 12 mm in diameter. More specifically, it is made up of a metallic core and a foamed layer. The metallic core is made of stainless steel, and is 6 mm in diameter. The foamed layer is made of urethane sponge, and covers the peripheral surface of the metallic core. The urethane sponge layer, that is, the surface layer, is roughly $10^4$ Ω·cm-$10^{12}$ Ω·cm in volumetric resistivity. It is a layer formed of foamed rubber. In this embodiment, the developing apparatus 4 is structured so that the distance between the metallic core of the development roller 4*b* and that of the supply roller 4*c* is 6.5 mm. Theoretically, therefore, the urethane sponge layer of the supply roller 4*d* compresses the surface layer of the development roller 4*b* by 1.5 mm. The development blade 4*d* is an elastic blade made of thin plate of metal such as SUS, copper phosphate, or made of urethane rubber or the like.

The developing apparatus 4 in this embodiment is a part of an image formation unit which is removably mountable in the main assembly by carrying out a preset procedure. When the developing apparatus 4 (image formation unit) is in its image forming position in the apparatus main assembly, the development roller 4*b* is roughly parallel to the drum 1, and is in contact with the drum 1, with the presence of a preset amount of contact pressure between the development roller 4*b* and drum 1. The area of contact (interface) between the peripheral surface of the development roller 4*b* and the peripheral surface of the drum 1 is the developing position a (development area a). The image formation unit is a unit which has at least a developing apparatus for developing a latent image formed on an image bearing member into a visible image with the use of toner, and which is removably mountable in the main assembly of an image forming apparatus. The image formation unit in this embodiment is a development cartridge which is removably mountable in the main assembly of the image forming apparatus 100. An image formation unit can be removably mounted in the main assembly of an image forming apparatus by an ordinary user himself or herself. Thus, it makes it easier to maintain an image forming apparatus. When the developing apparatus 4 in the form of a development cartridge is properly situated in a preset position in the apparatus main assembly, the information transmitting portion 81 of a storage device 80 (storage devices: memory, semiconductor memory) with which the developing apparatus is provided faces the information transmitting portion 82 of the apparatus main assembly, making it possible for the storage device 80 and control portion 50 to exchange electrical information through the information transmitting portions, which are communicating means. The storing means 80 stores the information regarding the history of the image formation apparatus usage. The data writing-reading portion of the control portion 50 writes information into the storing apparatus 80 by way of information transmitting portions 81 and 82. The information transmitting portions 81 and 82, and data writing-and-reading portions of the control portion 50, are the means for writing information into the storing apparatus 80, and reading information from the storing apparatus 80.

Further, when the developing apparatus 4 is in the proper position in the apparatus main assembly, the force for driving the development roller 4*b*, supply roller 4*c*, and toner sending member 4*g* is transmittable from a driving means (unshown) of the apparatus main assembly, and further, a preset development roller bias and a preset supply roller bias can be applied to the development roller 4*b* and supply roller 4*c* from the development roller bias generation circuit 47 and supply roller bias generation circuit 49, respectively, of the apparatus main assembly. The above-mentioned development roller bias generation circuit 47 and supply roller bias generation circuit 49 are the voltage applying apparatuses for applying voltage to the development roller 4*b* and supply roller 4*c*, respectively. The development roller 4*b* is rotated at a preset speed in the clockwise direction (which is same as direction in which peripheral surface of drum 1 moves in development position a), which is opposite to the rotational direction of the drum 1. In this embodiment, in order to ensure that the image forming apparatus 100 forms images which are satisfactorily high in density, the peripheral velocity of the development roller 4*b* is set to roughly 170% of the process speed, that is, the peripheral velocity of the drum 1. The supply roller 4*c* is rotated at a preset speed in the same direction as the development roller 4*b* (so that direction in which its peripheral surface moves in area of contact between supply roller 4*c* and development roller 4*b* becomes opposite from direction in which peripheral surface of development roller 4*b* moves in area of contact). The toner sending member 4*g* also is rotated at a preset speed in the clockwise direction indicated by an arrow mark. As the supply roller 4*c* is rotated in the same direction as the development roller 4*b*, it supplies the development roller 4*b* with the toner T, in the area of contact between the supply roller 4*c* and development roller 4*b*, while scraping away from the peripheral surface of the development roller 4*b*, the portion of the toner T on the peripheral surface of the development roller 4*b*, which was not consumed for the development at the development position a during the preceding rotation of the development roller 4*b*. As the toner sending member 4*g* is rotated, it conveys the toner T in the developer container 4*a* toward a development chamber where the development roller 4*b* and supply roller 4*c* are located, while stirring the toner T. The body of toner T with which the development roller 4*b* is supplied by the supply roller 4*c* is conveyed to the nip between the development roller 4*b* and development blade 4*d* by the rotation of the development roller 4*b*, and then, is conveyed through the nip, by the further rotation of the development roller 4*b*. Consequently, not only is the body of toner T on the development roller 4*b* regulated by the nip, being thereby formed into a thick layer of toner T which is uniform in thickness, but also, is charged to a preset polarity (which is negative in this embodiment). Then, the thin layer of toner T is conveyed to the development position a by the further rotation of the development roller 4*b*. When the image forming apparatus 100 is in an image forming operation, −300 V of DC voltage (development roller bias for development), which is the same in polarity as the normal polarity to which toner particles are charged) is applied to the development roller 4*b* from the circuit 47, whereby the electrostatic latent image on the drum 1 is developed into a visible image, that is, an image formed of toner; the electrostatic latent image is reversely developed by the development roller 4*b* which is in contact with the drum 1 and bearing the single-component developer (toner).

As the developing apparatus 4, which is in the form of a cartridge, is used for image formation, the toner T in the developer container 4*a* is consumed. Thus, the developing apparatus 4 is equipped with a means (unshown) for detecting the amount of the toner remainder in the developer container 4*a*. The detected amount of the toner remainder is compared by the control portion 50 with a threshold value preset for the predicting, and/or warning a user, of the remaining length of the service life of the cartridge (developing apparatus 4). If the detected amount of the toner remainder is no more than the threshold value, the prediction of, and/or warning regarding, the remaining length of the service life of the cartridge (developing apparatus 4), is displayed on the display 51*b* of the control panel 51 of the image forming apparatus 100, and/or display 53*a* of the host apparatus 53, to prompt a user to prepare a replacement cartridge (developing apparatus 4), or replace the cartridge (developing apparatus 4) in the apparatus 100 so that the performance of the apparatus 100 remains at a satisfactory level in image quality. Incidentally, the developing apparatus 4 does not need to be in the form of a cartridge; it may be of the such a type that is built in as a part of the main assembly of the apparatus 100, and also, that its developer container 4*a* can be replenished with a fresh supply of toner as necessary.

(3) Operational Sequence of Image Forming Apparatus

Figure 1B:
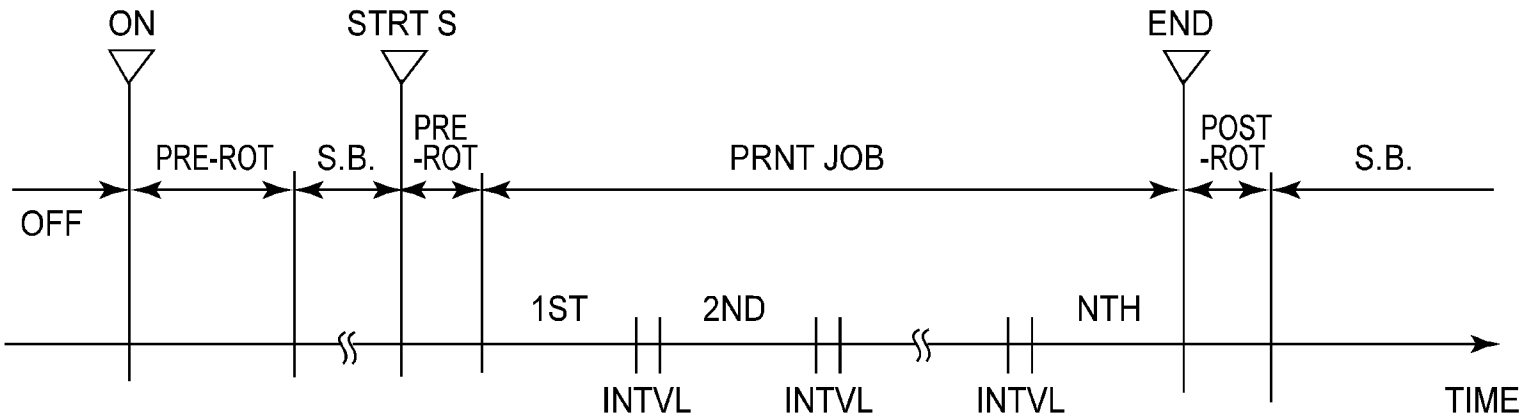
FIG. 1B is an operational sequence diagram of the image forming apparatus.

Next, referring to FIG. 1B, the operational sequence of the above-mentioned image forming apparatus 100 will be described.

A. Preliminary Multiple Rotation Step:

This is a step carried out during the period in which the image forming apparatus 100 is started up (startup period, warm-up period). As the main electric power source switch SW of the image forming apparatus 100 is turned on, the control portion 50 rotates the drum 1 by driving the motor, and also, causes the processing devices, such as the recording sheet feeding mechanism, recording sheet conveying mechanism, developing apparatus 4, transfer roller 7, fixing apparatus 10, etc., to make them perform their preparatory operations.

B. Preparatory Rotation Step:

This is a step carried out during the period in which a preparatory operation for image formation is carried out as an image formation start signal S is inputted, and in which the abovementioned processing devices, etc., are prepared for image formation. Primarily, the laser scanner 3 is started up; the transfer bias is set; the fixing apparatus 10 is adjusted in fixation temperature; and the like operations are carried out. In a case where an image formation start signal S is inputted while the image forming apparatus 100 is performing the preparatory multiple rotation step, the preparatory rotation step is carried out immediately after the completion of the preparatory multiple rotation step. After the completion of the preparatory multiple rotation step, if no image formation start signal S is inputted, the motor is temporarily stopped, stopping thereby the rotation of the drum 1, and then, the image forming apparatus 100 is kept on standby until an image formation start signal S is inputted. Then, as an image formation start signal S is inputted, the preparatory rotation step is carried out.

(C) Image Formation Step

As soon as the preset preparatory rotation step is completed, an image formation step (printing step) is started. In the image formation step, a recording sheet P is fed into the apparatus main assembly with a preset timing; the peripheral surface of the drum 1 is uniformly charged by the charge roller 2; the charged portion of the peripheral surface of the drum 1 is scanned by an image forming beam of light to form an electrostatic latent image on the peripheral surface of the drum 1; the electrostatic latent image is developed with toner; etc. That is, the processes for forming an image on the peripheral surface of the drum 1 are carried out; the toner image formed on the peripheral surface of the drum 1 is transferred onto the recording sheet S; the toner image is fixed to the recording sheet S by the fixing apparatus 10; and then, a finished print is outputted. When the image forming apparatus 100 is in the image formation mode for continuously yielding multiple prints, the above described image forming operation is continuously repeated until a preset number of prints are outputted.

D. Recording Sheet Interval

The recording sheet interval is the period between when the trailing edge of the preceding recording sheet P comes out of the transfer nip N and when the leading edge of the next recording sheet P arrives at the transfer nip N, that is, the period in which no recording sheet P is moving through the fixation nip N.

E. End Rotation Step

This is a step carried out in the period which comes after the completion of an image forming operation for forming a single print, or after the completion of the last print in an image forming operation for yielding multiple prints, and in which the driving of the motor is continued to rotate the drum 1 for a while to cause the image forming apparatus 100 to perform the preset end operation.

F. Standby Period

After the completion of the end rotation step, the driving of the motor is stopped to stop the rotation of the drum 1, and then, the image forming apparatus 100 is kept on standby until the next image formation start signal S is inputted.

(4) Control for Causing Supply Roller to Expel Toner

In the end rotation step, the control portion 50 keeps the supply roller bias, which is applied to the supply roller 4*c* from the circuit 49, set to such a polarity that makes the supply roller expel toner, during at least a part of the period between when the development of a latent image is completed and when the rotation of the supply roller 4*c* is stopped. More concretely, it is assumed here that the voltages applied to the development roller 4*b* and supply roller 4*c* while a latent image is developed into a visible image are Vd1 and Vs1, respectively; and the potential levels of the development roller 4*b* and supply roller 4*c* during at least a part of the period between when the development of a latent image into a visible image is ended and when the rotation of the supply roller 4*c* is stopped are Vd2 and Vs2, respectively. In this step, Vd2, Vd1,1−Vd1)) become the same in polarity as the normal polarity to which the toner is charged. That is, if the normal polarity of the toner used for image formation is negative, the above-mentioned voltages are controlled so that the values of A and B become negative. As these voltages are controlled so that the polarity of A becomes the same as the normal polarity for the toner, an electric field which works in the direction to move the toner from the supply roller 4*c* to the development roller 4*b* is generated. Further, as these voltages are controlled so that the polarity of B becomes the same as the normal polarity for the toner, this electric field becomes stronger than when the latent image is being developed into a visible image. That is, it is possible to reduce the amount of toner particles in the foamed layer of the supply roller 4*b* by causing the formed layer of the supply roller 4*c* to expel toner, during the period between when the development of the latent image into a visible image is completed and when the rotation of the supply roller 4*c* is stopped. Incidentally, the "development of a latent image into a visible image" mentioned in this paragraph means the development of the last latent image, or only image, to be formed in an image forming operation for yielding multiple prints, or only a single print, respectively, into a visible image, before the end rotation is started toward the end of the image forming operation. That is, it does not mean the development of a latent image into a visible image, which occurs prior to the development of the last latent image, or only latent image, into a visible image in an image forming operation.

Figure 2A:
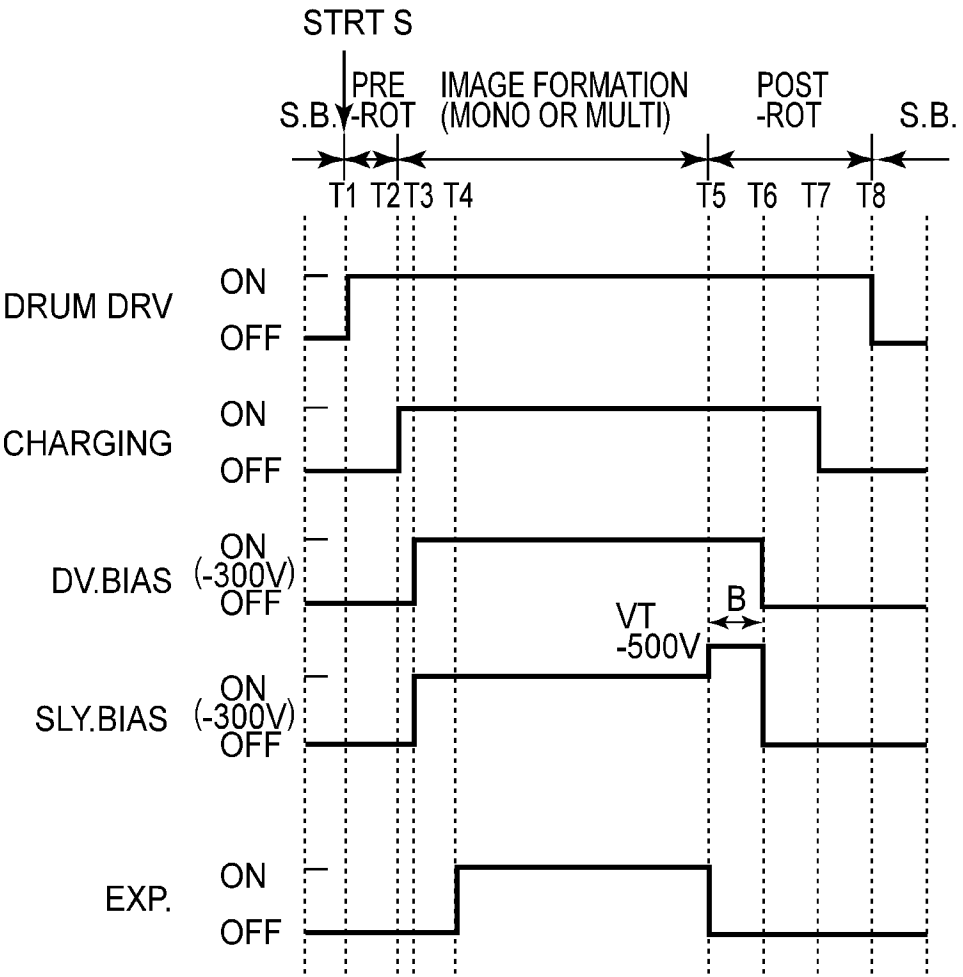
FIG. 2A is a view illustrating application timing of a developing roller bias voltage and a supplying roller bias of the image forming apparatus relating to Embodiment 1.

Next, referring to FIG. 2A, the series of controls which are to be carried out with the progression of an image forming operation will be described, including the actual values of the abovementioned biases involved in the expulsion of toner, etc. As the control portion 50 receives an image formation start signal S from the host apparatus 53 while the image forming apparatus 100 is on standby, it begins to drive the motor to rotate the drum 1 (time T1), and makes the apparatus 100 to carry out the preparatory rotation step. Then, as soon as the preset preparatory rotation step is completed, the control portion 50 begins to cause the charge roller 2 to charge the drum 1 (time T2); it starts image formation step. During this period, the development bias to be applied to the development roller 4*b*, and the supply roller bias to be supplied to the supply roller 4*c*, are kept turned off. Then, as soon as a preset length of time elapses (time T3) from the time T2, the control portion 50 starts the application of the development roller bias to the development roller 4*b*. The timing with which the control portion 50 starts applying the development roller bias to the development roller 4*b* corresponds to the length of time it takes for a given point of the peripheral surface of the drum 1, in terms of the rotational direction of the drum 1, to be moved from the drum charging position t to the development position a by the rotation of the drum 1. That is, the control portion 50 starts the application of the development roller bias to the development roller 4*b* at the moment when a given point of the peripheral surface of the drum 1, in terms of the rotational direction of the drum 1, which is at the charging position t when the charging of the drum 1 is started, arrives at the development position a. At the same time, the control portion 50 turns on the supply roller bias to the supply roller 4*c*. In this embodiment, the development roller bias (potential level) is −300 V, and the supply roller bias (potential level) to the supply roller 4*c*, is also −300 V; two biases are the same in potential level. The toner supplied to (coated on) the development roller 4*b* by the supply roller 4*c* is smoothed into a thin layer by the development blade 4*d* while being frictionally charged to the negative polarity. Then, the toner, borne in a thin layer on the development roller 4*b*, is conveyed out of the development container 4*a* by the rotation of the development roller 4*b*, and then, is conveyed by the further rotation of the development roller 4*b*, to the development position a, in which it comes into contact with the drum 1. In the development position a, the potential level of the drum 1 is the same as the potential level to which the drum 1 has been charged (potential level VD of unexposed points, which is −500 V), which is higher than the development roller bias which is −300 V. Therefore, when the toner on the development roller 4*b* comes into contact with the drum 1 by being conveyed by the development roller 4*b*, it does not adhere to the drum 1. Thereafter, the control portion 50 gives the laser scanner 3 the image data, and causes the laser scanner 3 to begin exposing the peripheral surface of the drum 1 (time T4), effecting thereby an electrostatic latent image on the peripheral surface of the drum 1. In this embodiment, as a given point of the charged portion of the peripheral surface of the drum 1 is exposed, its potential level attenuates to −100 V (potential level VL of exposed point). Thus, the electrostatic latent image, the pattern of which reflects the pattern of exposure is effected on the peripheral surface of the drum 1 by the electrostatic contrast between the potential level VD (−500 V) of exposed points and the potential level DL (−100 V) of unexposed points. Therefore, as the exposed points of the peripheral surface of the drum 1 are moved to the development position a by the rotation of the drum 1, the toner on the development roller 4*b* adheres only to these points, because in the development position a, the potential level (−300 V) of the development roller 4*b* is higher than that (−100 V) of the exposed points of the peripheral surface of the drum 1. In other words, the electrostatic latent image is developed.

As soon as the charged portion of the peripheral surface of the drum 1 is exposed for an image forming operation for yielding a single print, or for the last print in an image forming operation for yielding multiple prints, the control portion 50 switches the bias, which is to be applied to the supply roller 4*c*, to the toner expulsion bias TV, at the point in time when the last exposed point on the peripheral surface of the drum 1, in terms of the rotational direction of the drum 1, arrives at the development position a, that is, the point (time T5) in time when the development of the last latent image into a visible image is completed. Then, the control portion 50 continuously applies the toner expulsion bias VT to the supply roller 4*c* for a preset period B (from time T5 to time T6): period in which it is unnecessary to develop latent image on image bearing member into visible image, that is, a part of the period prior to the stopping of the rotation of the supply roller 4*c*. The toner expulsion bias VT is a bias for electrostatically expelling toner from the supply roller 4*c* to the development roller 4*b* by the difference in potential level between the supply roller 4*c* and development roller 4*b*. In this embodiment, the supply roller bias (−300 V) for the supply roller 4*c*, which is the same in potential level as the development roller bias (−300 V) for the development roller 4*b* is switched to −500 V (toner expulsion bias), which is significantly higher than −300V. That is, the potential level of the supply roller 4*c* becomes "more negative" than that of the development roller 4*b*; the development roller 4*b* becomes less in potential level than the supply roller 4*c*. Thus, a potential level difference of −200 V, which causes the negatively charged toner to expel from the supply roller 4*c* toward the development roller 4*b*, is created between the development roller 4*b* and supply roller 4*c*. At the point (T6) in time when the preset period B during which the toner expulsion bias is continuously applied to the supply roller 4*c* ends, the control portion 50 stops the application of the development roller bias to the development roller 4*b* and the application of the supply roller bias to the supply roller 4*c*. Then, at a point (T7) in time which is a preset length of time after the point (T6) in time when the preset period B ends, the control portion 50 stops the application of the charge bias to the charge roller 2. Then, the control portion 50 stops (time T8) driving the drum 1 after the completion of the preset end rotation step. Then, it puts the image forming apparatus 100 on standby, and waits for the inputting of the next image formation start signal S.

The image forming apparatus 100 in this embodiment is structured so that the rotation of the supply roller 4*c* is stopped at the same time the rotation of the drum 1. It has been thought that one of the reasons why images suffering from cyclic density unevenness image are formed is that the sponge layer of a supply roller is left compressed for a substantial length of time while the roller is not rotated. More specifically, as the sponge layer of a supply roller is left compressed for a substantial length of time while the roller is not rotated, the compressed portion of the sponge layer becomes clogged with toner. Thus, the amount by which this portion of the sponge layer of the supply roller supplies the development roller with toner will be substantially smaller than the normal amount. In this embodiment, therefore, the toner expulsion bias VT is applied to the supply roller 4*c* during the end rotation step to cause the supply roller 4*c* to expel the toner on its peripheral surface toward the development roller 4*b*, as described above. As the toner is expelled from the supply roller 4*c* toward the development roller 4*b*, it moves with the movement of the peripheral surface of the supply roller 4*c*, while gradually moving away from the supply roller 4*c*, being thereby dispersed onto the toner T in the developer container 4*a* by the rotation of the supply roller 4*c*. In other words, the toner on the peripheral surface of the supply roller 4*c* can be removed by causing the supply roller 4*c* to expel the toner. With virtually no toner on the peripheral surface of the supply roller 4*c*, even if the image forming apparatus 100 is kept unattended for a substantial length of time, the surface portion of the sponge layer of the supply roller 4*c* is prevented from being clogged with toner, being thereby preventing from making the supply roller 4*b* unstable in the amount by which it supplies the development roller 4*b* with toner. Incidentally, it is desired that the supply roller 4*c* is rotated no less than one full turn during the period B in which the toner expulsion bias is continuously applied to the supply roller 4*c*, that is, the period from time T5 to time T6, for the following reason. That is, rotating the supply roller 4*c* no less than one full turn ensures that toner will have been expelled by the toner expulsion bias VT, from the portion of the peripheral surface of the supply roller 4*c*, which will be in contact with the development roller 4*b* when the rotation of the supply roller 4*c* is stopped. However, even if the supply roller 4*c* is not rotated no less than one full turn during the period B, the probability with which the clogging of the supply roller 4*c* will occur is significantly reduced by the application of the toner expulsion bias to the supply roller 4*c*. Therefore, it is not mandatory for the supply roller 4*c* to be rotated no less than one full turn. As for the value to which the toner expulsion bias VT is set, it is desired to be in such a range that does not cause unwanted side effects (leak to development roller 4*b*, and the like). Incidentally, in this embodiment, during the period in which a latent image is developed into a visible image, the development roller bias and supply roller bias are kept the same in potential level. This setup, however, is not mandatory for the present invention. That is, the development bias and supply roller bias may be independently changed in potential level as necessary to change the development condition, which is obvious.

(4) Verification of Effect of Toner Expulsion Bias

Given next is the evaluations of the control executed to expel toner from the supply roller 4*c*. More concretely, the images formed in an image forming operation carried out after the elapse of a preset length of time since the completion of an image forming operation in which the toner expulsion control was carried out were compared, in terms of the extent of cyclic density unevenness image, with the images (comparative images) formed in an image forming operation carried out after the elapse of the abovementioned preset length of time since the completion of an image forming operation in which the toner expulsion control was not carried out. More specifically, the image forming apparatus 100 was kept unattended for 24 hours after the completion of an image forming operation, and then, another image forming operation was carried out to form monochromatic black images. Then, the images were evaluated in terms of the density anomalies. The results of the evaluations are shown in Table 1 given below. Referring to Table 1, the voltage [V] between the supply roller 4*c* and development roller 4*b* is the amount of difference in potential level created between the supply roller 4*c* and development roller 4*b* by the bias applied to the supply roller 4*c* to expel toner from the supply roller 4*c* toward the development roller 4*b*. The voltages [V] in Tables 2, 4, and 4-9 which will be provided later are the same in definition as the voltage [V] in Table 1.

TABLE 1

| | VOL. BTWN S-ROLLER & D-ROLLER [V] | | | |
|---|---|---|---|---|
| | 0 V | −100 V | −250 V | −350 V |
| COMP. EX. | N | — | — | — |
| EMB. | N | F | G | G |

In Table 1, which shows the extent of suppression of the production of the cyclic density unevenness image, G stand for good or satisfactory; F stands for acceptable; and N stands for no good. That is, the images which suffered virtually no cyclic density unevenness image were judged G (good); the images which suffered from a small amount of cyclic density unevenness image was judged GF; the images which suffered from a negligible amount of cyclic density unevenness image were judged F; and the images which suffered from a significant amount of cyclic density unevenness image were judge N. The following are evident from Table 1: setting the biases so that the abovementioned potential level difference becomes zero cannot prevent the image forming apparatus 100 from forming images which suffer from the cyclic density unevenness image; only by setting the biases so that the potential level difference becomes substantial can prevent the apparatus 100 from forming images which suffer from the cyclic density unevenness image. It became evident that keeping the difference in potential level between the supply roller 4*c* and development roller 4*b* in a range −250 V-350 V can prevent the image forming apparatus 100 from forming images which suffer from the cyclic density unevenness image, from when it is brand-new to when the toner in the development cartridge is depleted by consumption.

In the above-mentioned subsequent (second) image forming operation, the latent images are developed through the same processes as the processes described above. That is, during the period in which the peripheral surface of the drum 1 is not exposed and no latent image is developed (preset period in which it is unnecessary to develop latent image on image bearing member into visible image), the voltage to be applied to the supply roller 4*c* is controlled as follows. That is, the bias to be applied to the supply roller 4*c* is switched to the toner expulsion bias in order to generate an electric field which works in the direction to expel toner from the supply roller 4*c* toward the development roller 4*b*, so that the toner on the peripheral surface of the supply roller 4*c* will be expelled from the supply roller 4*c* to prevent toner from accumulating and remaining on the peripheral surface of the supply roller 4*c*. In other words, this embodiment makes it possible to continuously and satisfactorily supply the development roller 4*b* with toner, without causing the peripheral surface of the supply roller 4*c* to be clogged with toner. Therefore, this embodiment makes it possible to prevent the image forming apparatus 100 from forming images which suffer from cyclic density unevenness image; this embodiment makes it possible to prevent the apparatus 100 from reducing in image quality.

The above-described first embodiment is not intended to limit the present invention in scope. For example, in the above described embodiment, an electric field which works in the direction to expel toner from the supply roller 4*c* toward the development roller 4*b*, by switching the bias to be applied to the supply roller 4*c*, to such a bias that is "more negative" than the bias to be applied to the development roller 4*b*. However, the electric field for expelling toner from the supply roller 4*c* toward the development roller 4*b* may be generated between the supply roller 4*c* and development roller 4*b* by switching the bias for the development roller 4*b* to such a bias that is "more positive" than the bias to be applied to the supply roller 4*c*. Further, in the above described embodiment, the toner expelling operation was automatically performed by a preset sequential program. However, the image forming apparatus 100 may be designed (programmed) so that a user can initiate, as necessary, a toner expelling operation by giving an instruction to the apparatus 100 through the control panel 51 of the apparatus 100, or through the host apparatus 53. Further, in the above described embodiment, toner is expelled from the supply roller 4*c* toward the development roller 4*b* during the end rotation step, and therefore, the supply roller 4*c* is reduced in the amount of toner in its foamed layer during the end rotation step. Thus, during the initial stage of the following image forming operation, the supply roller 4*c* is likely to fail to supply the development roller 4*b* with a satisfactory amount of toner, which in turn is likely to cause the image forming apparatus 100 to form images which are insufficient in density. As for the solution to this problem, it is desired that an operation for impregnating the supply roller 4*c* with toner is carried out before the starting of the next image forming operation. That is, assuming that the potential level of the development roller and that of the supply roller 4*c* are Vd3 and Vs3, respectively, during at least a part of the period between when the rotation of the supply roller 4*c* is stopped after the completion of a latent image into a visible image, and when the development of a latent image into a visible image is started after the restarting of the supply roller 4*c*, all that is necessary is to design the image forming apparatus 100 so that the control portion 50 controls Vd3 and Vs3 in such a manner that (Vs3−Vd3) becomes opposite in polarity to the normal polarity to which toner is charged. For example, it is desired that Vd3 and Vs3 are set to −300 V and −100 V, respectively. By controlling the development roller 4*b* and supply roller 4*c* in potential level as described above, an electric field which causes toner to be attracted to the supply roller 4*c*. Therefore, it is possible to impregnate the supply roller 4*c* with toner. Further, instead of controlling Vd3 and Vs3 as described above, the length of time the supply roller 4*c* is rotated during the preparatory rotation step may be set so that the greater the above described toner expulsion bias, the longer the length of time the supply roller 4*c* is rotated. Further, the above-described embodiment may be variously modified as long as the modifications are in accordance with the gist of the present invention.

[Embodiment 2]

Figure 2B:
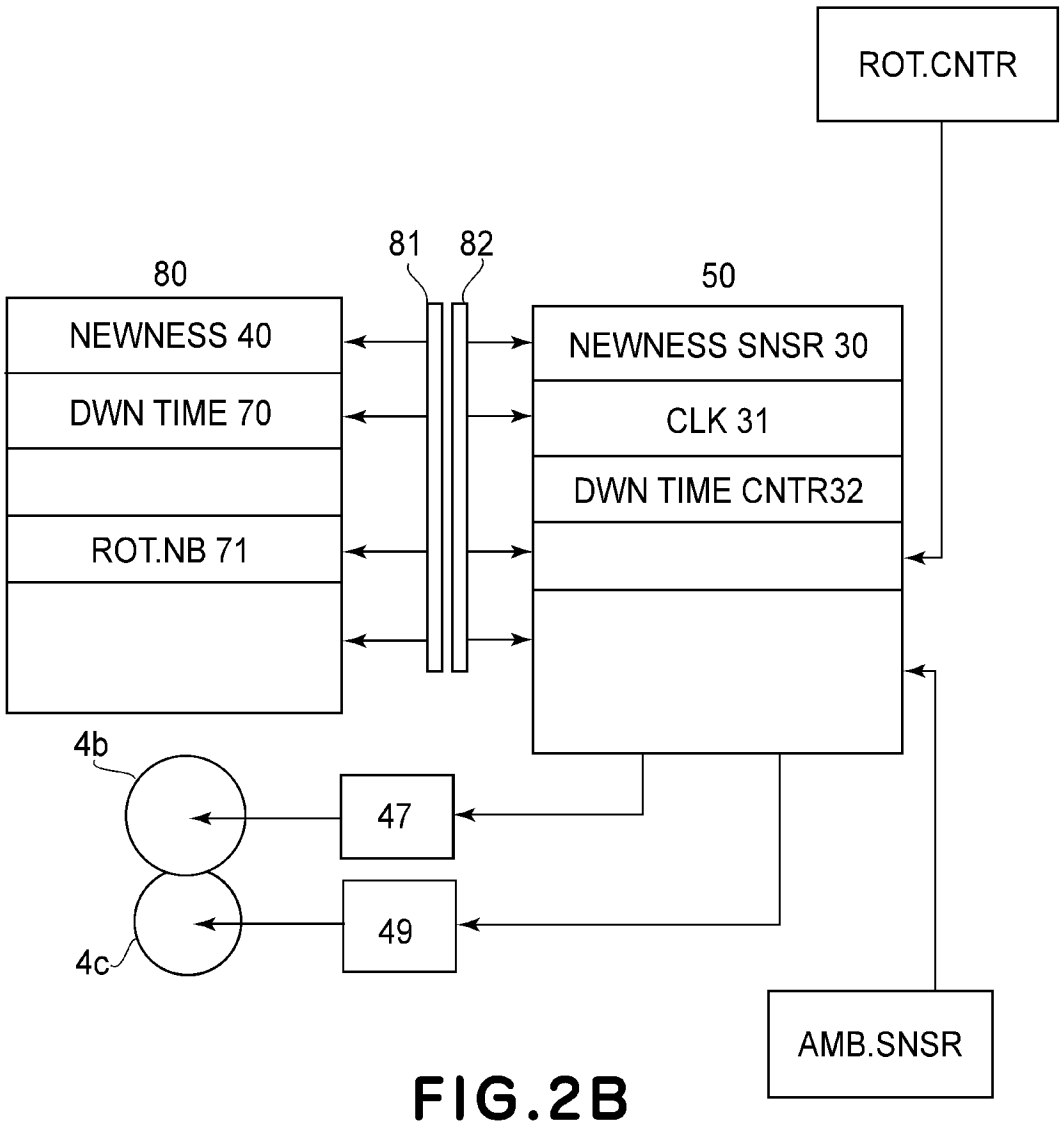
FIG. 2B is a block diagram illustrating a developing roller rotation counting method of the image forming apparatus relating to Embodiment 2.

A description will be made as to Embodiment 2 of the present invention referring to FIG. 1A, and FIG. 2B and FIG. 3A. The like reference numerals as in the foregoing embodiment are assigned to the elements having the corresponding functions The apparatus of this embodiment is provided with a rotation counting device 110 for detecting the information with respect to a drive rotation number of the developing roller, as first detecting means for detecting the information with respect to the record of use of the image forming apparatus. The apparatus is provided with an ambient condition detecting device 120, as a second detecting device for detecting the information with respect to an ambient condition of the image forming apparatus. In response to an ambient condition detected by the ambient condition detecting device 120, the electric field intensity for moving the toner toward the developing roller 4*b* from the supplying roller 4*c* is changed. The information with respect to the number of drive rotations of the developing roller 4*b* counted by the rotation counting device 110 is stored in the memory device 80, and the electric field intensity for moving the toner toward the developing roller 4*b* from the supplying roller 4*c* is changed in response to the integrated rotation number stored. In this embodiment, the controller 50 is provided with newness detecting means 30 with respect to the developing device 4 as the developing cartridge. Detected newness information 40 is stored in the memory device 80 of the developing device 4. In the controller 50, in the case where a new developing device 4 as the developing cartridge is mounted, the new one information detected immediately after the mounting thereof is stored in the memory device 80. The memory device 80 of the developing device 4 stores detected newness information 40 (the information which identifies whether the developing device 4 is the new one or not) of the developing device 4. The controller 50 recognizes whether or not the developing device 4 mounted to the main assembly is a new one by reading the detected newness information 40 of the memory device 80 from newness detecting means (newness detecting portion) 30. For example, in the new developing device, the information which shows that it is the new one is inputted in the memory device 80 thereof beforehand. By doing so, when the new developing device is mounted to the image forming apparatus, it can be determined that the developing device is a new one. When the image forming operation is carried out, the detected newness information of the memory device 80 is deleted.

The image forming apparatus 100 of this embodiment is provided with a temperature and relative humidity sensor, for example, inside of the image forming apparatus, as the ambient condition detecting device 120 for detecting the ambient condition, and a temperature and relative humidity sensor 120 measures temperature and relative humidity inside of the machine. A measurement result thereof is inputted to the controller 50. The image forming apparatus 100 is provided with a developing roller rotation counting device 110. A number of developing roller rotations is substantially proportional to a number of prints, and therefore, the developing roller rotation counting device 110 in this embodiment detects the number of developing roller rotations by counting the number of prints. The number of the rotations of the memory device 80 is integrated and the integrated number of rotations is stored. The controller 50 determines the image forming operation and the voltage between the supplying roller and the developing roller described hereinafter more particularly by this developing roller rotation counting device 110. In this embodiment, the number of developing roller rotations indicating the information with respect to the record of use of the developing device is detected by detecting the number of prints, but it may be detected using a developing roller driving time and so on, or the number of developing roller rotations may directly be detected by an encoder.

The experiments have been carried out in which the new developing device 4 is used, and it is kept inactive for every printing 1000 sheets for the 24 hours, and thereafter the image forming operation is carried out, again up to 6000 sheets. In the experiments, the cyclic density unevenness image in the case of the resumption of the image forming operation after the keeping inactive for the 24 hours is checked. The table 2 shows the results of experimenters. As the ambient conditions during the experiments, the temperatures and the humidifies s detected by the temperature and relative humidity sensor 120 are the normal temperature and normal humidity condition, the high temperature/high humidity ambient condition, and the low temperature/low humidity ambient condition. In this embodiment, the temperature is ° C.18-25° C. in the normal temperature and normal humidity condition, and the humidity is %30-60%. The temperature is higher than ° C. 25 in the high temperature/high humidity ambient condition, and it is more humid than 60%. The temperature is lower than ° C. 18 in the low temperature/low humidity ambient condition, and the humidity is lower than 30%.

TABLE 2

| COUNTS | LT/LH | NT/NH | HT/HH |
|---|---|---|---|
| 1000 | N | GF | G |
| 2000 | N | F | GF |
| 3000 | N | N | F |
| 4000 | N | N | N |
| 5000 | N | N | N |
| 6000 | N | N | N |

The suppression level of the cyclic density unevenness image: "G"=satisfactory; "GF"=density unevenness is slightly observed; "F"=acceptable; "N"=no good.

The following experiments were repeated, and the results of experiments were evaluated. In the low temperature/low humidity ambient condition, by controlling the bias voltages applied to the supplying roller 4*c* and the developing roller 4*b*, at a predetermined developing roller drive rotation number, strength of the electric field for moving the toner toward the developing roller 4*b* from the supplying roller 4*c* is changed. The print results (visual evaluation) for producing the samples of the cyclic density unevenness image are shown in Table 3.

TABLE 3

| | VOLTAGE BETWEEN S-ROLLER & D-ROLLER [V] | | | | | |
|---|---|---|---|---|---|---|
| | −100 V | −200 V | −300 V | −400 V | −500 V | −600 V |
| INITIAL | GF | G | G | G | G | G |
| 1000 PRINTS | F | GF | G | G | G | G |
| 2000 | F | F | G | G | G | G |
| 3000 | F | F | GF | G | G | G |
| 4000 | N | N | F | G | G | G |
| 5000 | N | N | N | GF | G | G |
| 6000 | N | N | N | GF | G | G |

The suppression level of the cyclic density unevenness image: "G"=satisfactory; "GF"=density unevenness is slightly observed; "F"=acceptable; "N"=no good.

In the experiment, a print pattern of a printing rate 1% is used, and the intermittent printing operation is carried on the two sheets, and the samples of the cyclic density unevenness image are produced and evaluated. The voltages V between a supplying roller and developing roller given in the top line of Table 3 are the differences provided by deducting the potential of the developing roller from the potential of the supplying roller, and the intensity of the electric field for moving the toner toward the developing roller 4*b* from the supplying roller 4*c* increases with the increase of the value V in the negative direction, in this embodiment. This potential difference is changed by 100V from −100V to −600V, for the evaluation. Furthermore, with the strength of the electric field changed in this manner, in two sheet intermittent printing operation, the printing operation for the 1000 sheets is carried out up to the 6000 sheets from the time of an initial provision, and thereafter, the cyclic density unevenness image is evaluated. As a result, the results of the evaluation are indicated: the suppression level of the cyclic density unevenness image: "G"=satisfactory; "GF"=density unevenness is slightly observed; "F"=acceptable; "N"=no good.

From Table 3, it is understood that the production level of the cyclic density unevenness image becomes worse with the increase of the number of prints. It is considered that this is because with the increase of the number of prints, the rubbing of the toner by the rotation of the developing roller deteriorates the toner, and therefore, the electrostatic property of the toner decreases with the result that the toner becomes hard to discharge in spite of the application of the bias. Therefore, from Table 4, the production of the cyclic density unevenness image can be suppressed from the beginning of life to the 6000 sheets, by changing the potential difference between the supplying roller and the developing roller in accordance with the number of prints.

Table 4 shows the control with which the cyclic density unevenness image does not occur even in the case of the low temperature/low humidity ambient condition, but as will be understood from Table 2, the problem of the cyclic density unevenness image arises less in the high temperature/high humidity ambient condition than in the low temperature/low humidity ambient condition, and therefore, the potential difference may be controlled in accordance with the ambient condition, as shown in Table 11. By making the potential difference smaller in the high temperature/high humidity conditions than in the low temperature/low humidity ambient condition, as shown in Table 11, the production of the cyclic density unevenness image can be suppressed efficiently without the application of a large voltage. Even if the voltage higher than needed is applied, the production of the cyclic density unevenness image is suppressed, but when the strong voltage is applied for a long time, the toner may be fused on the developing roller in the last stage of long term operation. Therefore, by changing the potential difference in accordance with an ambient condition and number of prints as shown in the table 11, the cyclic density unevenness image can be suppressed without such a problem. In this embodiment, the potential difference is determined on the basis of both of the temperature and the humidity, but, the production of the cyclic density unevenness image can be suppressed by determining the potential difference on the basis of at least one of the temperature and the humidity. In the case where the potential difference is changed only on the basis of the temperature, the potential difference is increased with the reduction of the temperature, and in the case where the potential difference is changed only on the basis of the humidity, the potential difference is increased with the reduction of the humidity. The reason why tendency of the production of the cyclic density unevenness image changes depending on the temperature or the humidity is that the fluidity of the toner changes depending on the temperature or the humidity (the fluidity of the toner decreases with the reduction of the temperature or the humidity).

TABLE 4

| COUNTS | VOL. BTWN S-ROLLER & D-ROLLER [V] |
|---|---|
| INITIAL | −200 |
| 1000 | −300 |
| 2000 | −300 |
| 3000 | −400 |
| 4000 | −400 |
| 5000 | −500 |
| 6000 | −500 |

TABLE 11

| COUNTS | LT/LH | NT/NH | HT/HH |
|---|---|---|---|
| INITIAL | −200 | −100 | 0 |
| 1000 | −300 | −200 | −100 |
| 2000 | −300 | −200 | −100 |
| 3000 | −400 | −300 | −200 |
| 4000 | −400 | −300 | −200 |
| 5000 | −500 | −400 | −300 |
| 6000 | −500 | −400 | −300 |

Figure 3A:
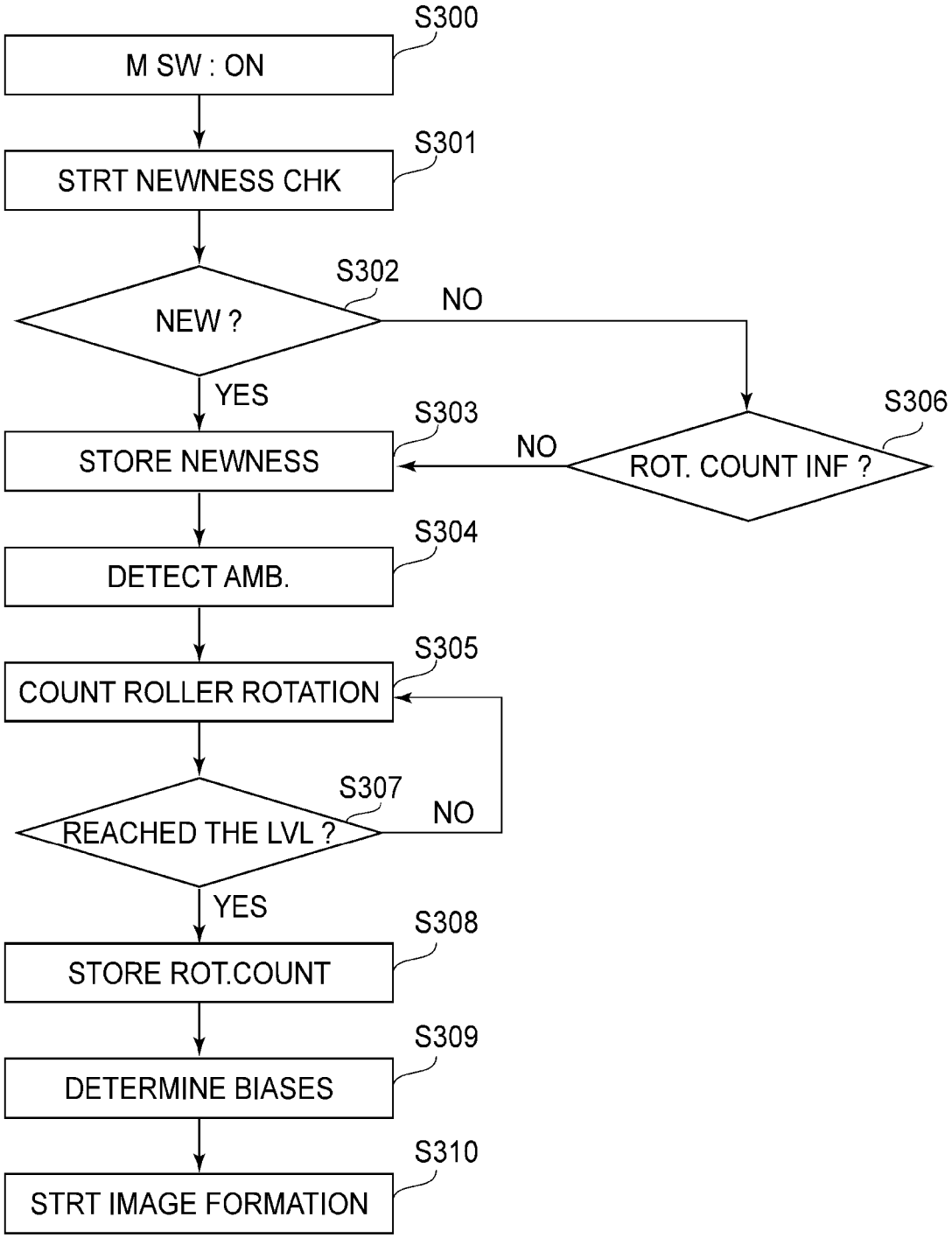
FIG. 3A is a flow chart flowchart illustrating the method of determining the voltage levels of the developing roller bias voltage and the supplying roller bias voltage in response to a developing roller rotation number, in the image forming apparatus relating to Embodiment 2.

Referring to FIG. 3A, the description will be made as to the process of the voltage determination of the supplying roller bias and the developing roller bias voltage which is the feature of this embodiment. When the main assembly power source of the image forming apparatus 100 is turned on, in other words, the main power supply switch SW is actuated (step S300), the controller 50 starts the sensing immediately, as to whether or not the developing device 4 mounted to the main assembly is a new one (S301). In other words, the newness detecting means 30 checks the presence or absence of the detected newness information 40 in the memory device 80 (S302). If the result of the newness check is affirmative, the detected newness information in the memory device 80 is eliminated, and simultaneously therewith, the signal is written in the memory device 80 during measurement of the number of developing roller rotations (S303). Then, an ambient condition detecting device (temperature/humidity sensor) 120 detects the temperature and relative humidity in the image forming apparatus (S304). The developing roller rotation counting device 110 starts the counting of the number of developing roller rotations (S305). When the controller 50 detects that the value of the number of developing roller rotations is the predetermined value, the controller 50 reads a counted number of rotations of the developing roller, and writes the information which shows the number of drive rotations of the developing roller into the memory device 80 (S308). Similarly, as shown in Table 4 and Table 11, the controller 50 determines the potential difference between the supplying roller and the developing roller in accordance with the number of the rotations of the developing roller (number of prints) and the ambient condition (S309). Thereafter, the image forming operation is started (S310). When the image forming operation starting at S310 finishes, the controller 50 controls the potential difference between the developing roller and the supplying roller at the potential difference determined at S309 in a part of a periods of the post-rotation to execute the toner ejecting operation. According to this embodiment, even if the ambient condition of the image forming apparatus changes, the production of the cyclic density unevenness image can be suppressed and stabilized images can be outputted throughout a lifetime of the developing device.

[Embodiment 3]

Figure 3B:
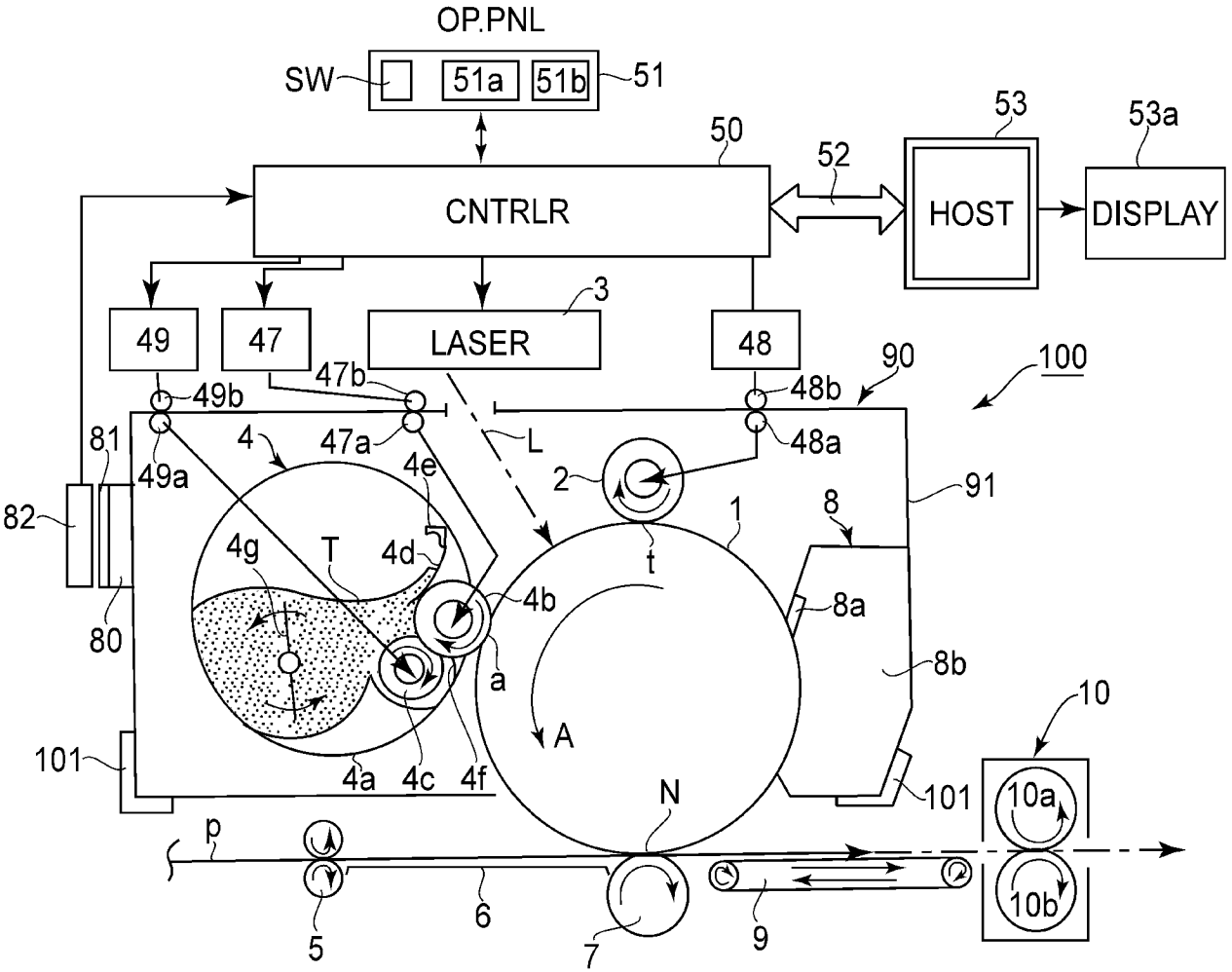
FIG. 3B illustrates the image forming apparatus according to Embodiment 3.

FIG. 3B is a general arrangement of the major part and a block diagram of the control system in the image forming apparatus 100 in the present Embodiment 3. In the image forming apparatus of the present Embodiment 3, the drum 1, the charging roller 2, the developing device 4, and the cleaning apparatus 8 in the image forming apparatus of Embodiment 1 is assembled in a cartridge frame 91 to constitute a process cartridge 90. In other words, these devices 1, 2, 4, 8 are detachably mountable to the apparatus main assembly of the image forming apparatus 100 all together (cartridge). Here, the process cartridge contains an image bearing member on which a latent image is formed, and at least one of process means including charging means, the developing device, and cleaning means which are integrated into a cartridge as a unit, and it is detachably mountable to the main assembly of the image forming apparatus. It may contain the image bearing member and the developing device are integrated into a cartridge as a unit, and it is detachably mountable to the main assembly of the image forming apparatus.

In the cartridge 90, a developing device frame (developing unit) supporting the developing device 4 and a cleaning frame (drum unit) supporting the drum 1, the charging roller 2, and the cleaning apparatus 8 are unified. The cartridge 90 is dismountably mounted relative to cartridge mounting means 101 provided in the main assembly of the image forming apparatus by the user. Therefore, the user can execute the maintenance of the apparatus, the exchange of a consumable product independently from a service person. The process cartridge 90, which is in the state of being mounted in the predetermined manner relative to the main assembly, can receive the driving force for driving the drum 1, the developing roller 4*b*, the supplying roller 4*c*, and the toner feeding member 4*g* from the main assembly side driving means (unshown). Furthermore, the charging bias voltage can be applied from a main assembly side charging bias voltage generating circuit 48 through a main assembly member side electrical contact 48*b* and a cartridge side electrical contact 48*a* to the charging roller 2. The developing roller bias voltage can be applied from the main assembly side developing roller bias voltage generating circuit 47 through a main assembly side electrical contact 47*b* and a cartridge side electrical contact 47*a* to the developing roller 4*b*. The supplying roller bias can be applied from a main assembly side supplying roller bias generating circuit 49 through a main assembly side electrical contact 49*b* and a cartridge side electrical contact 49*a* to the supplying roller 4*c*. In the state that the process cartridge 90 is mounted relative to the main assembly, the information transmitting portion 81 of the memory device 80 of the process cartridge 90 opposes to the main assembly side information transmission portion 82. By this, between the memory device 80 and the controller 50, transfer of the electric information is capable through the information transmission portions 81, 82 which are the communication means. The memory device 80 stores the information with respect to the condition of use of the image forming apparatus and the process cartridge 90. The data writing and reading means of the controller 50 carries out the reading and writing of the information through the information transmission portions 81, 82 to the memory device 80.

Also in the image forming apparatus of such a process cartridge mounting and dismounting type, the toner ejection control structure similar to the image forming apparatus of Embodiments 1 and 2 is employed, so that the similar effect can be provided. According to this embodiment, similarly to the image forming apparatus of Embodiments 1 and 2, the information on the number of developing roller drive rotations is written in the memory device 80, correctly and assuredly, and therefore, the production of the cyclic density unevenness image can be suppressed. The stabilized output images can be outputted, even before or after removal or inserting the cartridge 90. With the structure as described above, usability is improved greatly, and moreover, the manufacturer's load is reduced.

[Embodiment 4]

Part (a) of FIG. 4 is a schematic view of the major part of the image forming apparatus 100 of this embodiment. The image forming apparatus in the present Embodiment 4 uses the transfer type electrophotographic process, and it is a full-color laser beam printer of an in-line type (tandem type). In the description of this embodiment, the same reference numerals as in FIG. 1A and FIG. 3B are assigned to the elements having the corresponding functions in this embodiment, and the detailed description thereof is omitted for simplicity. Designated by Y, M, C, K are first-fourth image formation stations (image formation stations) for forming the toner images of the yellow (Y), magenta (M), cyan (C), and black (K) colors corresponding to a separated color of a full-color image. The first-fourth image formation stations are juxtaposed by the vertical one array at the top in the order named from the bottom in the main assembly. Part (b) of FIG. 4 is an enlarged view of one image formation station. The image formation stations Y, M, C, and K are each provided with electrophotographic process equipment such as a drum like electrophotographic photosensitive member (drum) 1 as the image bearing member, a charging roller 2, a laser optical device 3, a developing device 4, and a cleaning apparatus 8. The toner of the Y color is accommodated as the Y toner in the developing device 4 of a first image formation station. The toner of the M color is accommodated as the M toner in the developing device 4 of a second image formation station. The toner of the C color is accommodated as the C toner in the developing device 4 of a third image formation station C. The toner of the K color is accommodated as the K toner in the developing device 4 of the fourth image formation station.

Designated by 11 is an electrostatic transfer unit for transferring the toner images formed on the drum 1 of the image formation stations Y, M, C, and K onto the recording material P. The electrostatic transfer unit 11 has an endless electrostatic belt 12 circulated in contact to all the drum s 1, which are entrained between a driving roller 13 and a follower roller 14. Inside a belt 12, the transfer rollers 7 are provided interposing the belt 12 correspondingly to the drums 1 of the image formation stations Y, M, C, K, and they are elastically pressed and urged to the drum 1. In this embodiment, the transfer roller 7 is a sponge-like urethane rubber roller, and the high voltage can be applied thereto. In a bottom end of the belt 12, an electrostatic attraction roller 15 is provided in contact with the belt 12. The fixing device 10 is provided above the belt 12. The image formation stations Y, M, C, K are sequentially actuated in alignment with the predetermined control timing of an image formation sequence and the drums 1 are rotated in a clockwise direction of an arrow A. The belt 12 of the electrostatic transfer unit 11 is rotationally driven at the peripheral speed corresponding to a peripheral speed of the drums 1 counter-clockwisely by the driving roller 13.

The belt 12 is also rotationally driven in the rotational direction of the drum 1 at the peripheral speed the same as the drum 1 codirectionally. The belt 12 is a monolayer resin conveyor belt, which comprises a PET resin material, in which carbon black is dispersed to provide the resistance of $1\times10^{10}$ ohm.cm, and the thickness thereof is 130 micrometers, and a rib (unshown) bonded on the rear side thereof prevents a snaking movement and offsetting of the belt. By the rotation process of each drum 1, it is uniformly charged to the predetermined potential of the predetermined polarity (negative polarity in this embodiment) by the charging roller 2. The charged surface is exposed to the laser beam L modulated in accordance with the image data outputted from the laser beam study apparatus 3 to form an electrostatic latent image on each drum 1. The electrostatic latent image thereof is developed into a toner image by the developing device 4 (reverse development which uses the negative polarity toner in this embodiment). In this manner, the toner images of the color Y, the color M, the color C which is a separated color image of the full-color image are formed at predetermined sequence control timing through the electrophotographic process on the surface of the drums 1 of the image forming stations Y, M, C, and K.

On the other hand, in predetermined control timing, the recording material P is fed one by one from a feeding portion (unshown). A leading end of the recording material P abuts to the nip of a registration roller couple 5 which is at rest at that time and stops once. The registration roller couple 5 is rotationally driven in synchronism with the rotation of the belt 12 and the toner image formed on the drum 1. In this manner, the recording material P is guided into the transfer inlet guide 16 to be fed into between the electrostatic attraction roller 15 and the belts 12. The recording material P is interposed between the electrostatic attraction roller 15 and the belt 12 to press-contact against an outer periphery of the belt 12. The voltage is applied between the belt 12 and the electrostatic attraction roller 15. By this, the charge is induced in the recording material P which is the dielectric member and the dielectric layer of the belt 12. The recording material P is electrostatically attracted on the outer periphery of the belt 12. By this, the recording material P is stably attracted on the belt 12, and is fed to the downstreammost transfer portion by the movement of the belt 12. In the feeding process, at the transfer portions of the first-fourth image formation stations Y, M, C, K, the Y color, M color, C color, K color toner images formed on the surfaces of the drums 1 of the respective image formation stations are sequentially transferred superimposingly. By this, a full-color toner image is formed synthetically on the surface of the recording material P. The recording material P carrying the combined toner image is separated from the belt 12 by a curvature of the belt driving roller 13, and it is carried into the fixing device 10, where the composite toner image is heat-fixed on the surface of the recording material P, and the recording material P is discharged to the discharging portion (unshown) as a color print. In the first-fourth image formation stations Y, M, C and K, the deposited residual matter such as the untransferred toner is scraped off by the cleaning device 8 from each of the drums 1 after the toner image transferring onto the recording material P (cleaning) to be provided for the next image formation.

In the image formation stations Y, M, C and K, the drum 1, the charging roller 2, the developing device 4, and the cleaning apparatus 8 are assembled into a cartridge frame 91 into the process cartridge 90 which is detachably mountable relative to the main assembly of the image forming apparatus. The drum 1 of each of the image forming stations Y, M, C, and K is the negative charging OPC photosensitive member of a diameter 30 mm, and the process speed of the image forming apparatus in this embodiment is 50 mm/sec. The charging roller 2 of the charging device of each of the image formation stations Y, M, C, K has a actual resistance $1\times10^6$ ohms, and the charging roller 2 is press-contacted with a total pressure 9.8 Ns to the drum 1 (DC contact charging type). Each of the charging rollers 2 is supplied with a DC voltage of −1050V from the charging bias voltage generating circuit 48, so that the surface of the drum 1 is uniformly charged to the dark portion potential VD −500V. The portion of the drum 1 which is exposed to the laser beam is −100V (the light portion potential VL), by which an electrostatic latent image is sequentially formed on the photosensitive drum 1. The laser exposure of the drum is started with the so-called BD position signal in the polygon scanner for every scanning line in a main scanning direction (direction perpendicular to the feeding direction of the recording material), and with respect to the sub-scanning direction (an advancing direction of the recording material), the exposure starts with the delay of the predetermined time from a TOP signal provided by a switch in the sheet passage. By this, in the image forming stations, the exposures are effected on the same positions on the recording materials.

The developing device 4 of each of the image formation stations Y, M, C, K uses the non-magnetic one-component toner of the negative charging property (reverse-developing device of the contact type), similarly to the developing device 4 of the image forming apparatus of FIG. 1A, and FIG. 3B. In other words, the toner is the non-magnetic one-component developer, so-called non-magnetic toner which does not contain magnetic particles and the development is a one component contact type developing system. The developing roller 4*b* is rotated at the peripheral speed of 170% codirectionally with the drum 1, and variable voltage is applied from the developing roller bias voltage generating circuit 47 by a signal of the controller 50 during the developing operation. The developing devices of the image forming apparatus of this embodiment are the yellow, magenta, cyan, and black developing devices (four Colors), and the toner images of the respective color are formed (in-line type). As the information with respect to condition of use, the information with respect to the number of the rotations of the developing roller 4*b* of each of the developing device 4 is stored, and in response to the rotation number stored, the voltage for moving the toner toward the developing roller 4*b* from the supplying roller 4*c* is changed. The description will be made as to the structure for accomplishing this.

The right color tone is not provided in a color image forming apparatus 100, when the image densities vary due to the various conditions such as the change of the ambient condition, the print number. The evaluation of the cyclic density unevenness image is carried out for the stations Y, M, C and K of the image forming apparatus described above in the case that no voltage difference is provided between the developing roller bias voltage and the supplying roller bias at the end of the exposure operation (Comparison example). The image forming operation is once carried out by the experimental device described above, and then it is kept inactive for the 24 hours, and thereafter, the image forming operation is carried out, and then, the density unevenness of the output image (solid black) is checked. The evaluation result is shown in Table 5.

TABLE 5

| IMAGE FORMING STATION | IMAGE LEVEL (ROLLER SET TRACE) |
|---|---|
| Y | G |
| M | G |
| C | F |
| K | N |

The suppression level of the cyclic density unevenness image: "G"=satisfactory; "GF"=density unevenness is slightly observed; "F"=acceptable; "N"=no good. As a result, it is understood the production levels of the cyclic density unevenness image are different depending on the developing devices. The reason for this difference is considered as being the difference among the amounts of supply of the yellow toner, the magenta toner, the cyan toner and the black toner to the developing roller 4*b* from the supplying roller 4*c* due to the difference among the charge amounts of the yellow toner, the magenta toner, the cyan toner, the black toner. Particularly, it has been confirmed that the C toner and K toner having high triboelectric charge tends to be large in the amounts of the toner remaining on the surface of the supply roller. The results of experimenters is shown in Table 6 (yellow toner), Table 7 (magenta toner), Table 8 (cyan toner), and Table 9 (black toner).

TABLE 6

| | VOLTAGE BETWEEN S-ROLLER & D-ROLLER [V] | | | | | |
|---|---|---|---|---|---|---|
| Y | −100 V | −200 V | −300 V | −400 V | −500 V | −600 V |
| INITIAL | G | G | G | G | G | G |
| 1000 | G | G | G | G | G | G |
| 2000 | G | G | G | G | G | G |
| 3000 | G | G | G | G | G | G |
| 4000 | GF | G | G | G | G | G |
| 5000 | F | GF | G | G | G | G |
| 6000 | N | F | G | G | G | G |

TABLE 7

| | VOLTAGE BETWEEN S-ROLLER & D-ROLLER [V] | | | | | |
|---|---|---|---|---|---|---|
| M | −100 V | −200 V | −300 V | −400 V | −500 V | −600 V |
| INITIAL | G | G | G | G | G | G |
| 1000 | G | G | G | G | G | G |
| 2000 | G | G | G | G | G | G |
| 3000 | G | G | G | G | G | G |
| 4000 | GF | G | G | G | G | G |
| 5000 | F | GF | G | G | G | G |
| 6000 | N | F | G | G | G | G |

TABLE 8

| | VOLTAGE BETWEEN S-ROLLER & D-ROLLER [V] | | | | | |
|---|---|---|---|---|---|---|
| C | −100 V | −200 V | −300 V | −400 V | −500 V | −600 V |
| INITIAL | G | G | G | G | G | G |
| 1000 | GF | G | G | G | G | G |
| 2000 | GF | G | G | G | G | G |
| 3000 | F | GF | F | G | G | G |
| 4000 | N | F | F | G | G | G |
| 5000 | N | N | N | GF | G | G |
| 6000 | N | N | N | GF | G | G |

TABLE 9

| | VOLTAGE BETWEEN S-ROLLER & D-ROLLER [V] | | | | | |
|---|---|---|---|---|---|---|
| K | −100 V | −200 V | −300 V | −400 V | −500 V | −600 V |
| INITIAL | GF | G | G | G | G | G |
| 1000 | F | GF | G | G | G | G |
| 2000 | F | F | G | G | G | G |
| 3000 | F | F | GF | G | G | G |
| 4000 | N | N | F | G | G | G |
| 5000 | N | N | N | GF | G | G |
| 6000 | N | N | N | GF | G | G |

In view of this, in this embodiment, in the respective developing devices 4, the voltages applied between the supply rollers 4*c* and the developing rollers 4*b* are set. By doing so, the voltages for the optimal the supply rollers 4*c* and the developing rollers 4*b* are set for the respective developing devices 4. By this, the production of the cyclic density unevenness image is suppressed, and even if the various conditions such as the change of the ambient condition, the print number changes, the right color tone is provided. Table 10 shows the results of the comparative evaluation between this embodiment and the comparison example, when the color image forming apparatus 100 which employs the present invention is operated in the low temperature and the low humidity ambient condition (15° C./10%) in which the cyclic density unevenness image tends to appear. The start and stop are repeated for every two-sheet printing in the image forming operation to the 5000 sheets which are the lifetimes of the developing device.

TABLE 10

| | IMAGE | COUNTS | | | | | |
|---|---|---|---|---|---|---|---|
| | FORMING STATION | 0 | 1000 | 2000 | 3000 | 4000 | 5000 |
| COMP. | Y | G | G | G | GF | F | N |
| EX. 3 | M | G | G | G | GF | F | N |
| | C | G | F | N | N | N | N |
| | K | G | G | F | N | N | N |
| EMB. | Y | G | G | G | G | G | G |
| | M | G | G | G | G | G | G |
| | C | G | G | G | G | G | G |
| | K | G | G | G | G | G | G |

The suppression level of the cyclic density unevenness image: "G"=satisfactory; "GF"=density unevenness is slightly observed; "F"=acceptable; "N"=no good. From the above-described results of experiments, it has been confirmed that by providing the optimal voltage between the developing roller 4*b* and the supplying roller 4*c*, the production of the cyclic density unevenness image is suppressed. By doing so, in the developing device of each color, the image is stably formed without the production of the cyclic density unevenness image, so that n the multicolor image which has the satisfactory color balance is provided. By the above-described structure, also in wide ambient conditions and in larger number printing, an image output is stabilized, the multicolor images which have the satisfactory color balance are formed, and the image which has the further stabilized density can be formed, and moreover, the multicolor image which has the satisfactory color balance can be provided.

In this embodiment, the process cartridge is as described above, but the present invention is not limited to this. In other words, the present invention is applicable if the cartridge 90 includes the developing device 4 for visualizing the latent image formed on the image bearing member 1 by the toner T. The image bearing member 1 is a member on which the latent image developed with the toner T is formed. It may be an electrophotographic photosensitive member which utilizes the electrophotographic process, as in the embodiment, and it may be an electrostatic recording dielectric member which utilizes an electrostatic recording process, a magnetic recording member using a magnetic recording process, or like. The developing device 4 is not limited to the developing device of a contact type to which a toner carrying member 4*b* is contacted to the image bearing member 1, as in the embodiment. The developing device 4 may be a type in which the toner carrying member 4*b* is spaced by a predetermined small gap from the image bearing member 1, as with a so-called jumping developing system.

This application claims priority from Japanese Patent Applications Nos. 132042/2009 and 093017/2010 filed Jun. 1, 2009 and Apr. 14, 2010, respectively which are hereby incorporated by reference.

What is claimed is:

1. An image forming apparatus, comprising:

an image bearing member for bearing a latent image;

a toner carrying member for supplying toner to said image bearing member to visualize the latent image;

a rotatable toner supply member, contacted to said toner carrying member, for supplying the toner to the toner carrying member, said toner supply member including a surface foam layer;

a voltage applying device for applying voltages to said toner carrying member and said toner supply member;

a controller for controlling said voltage applying device such that A and B have a polarity which is the same as a regular charging polarity of the toner, where $$A = Vs2 - Vd2,$$

$$B = (Vs2 - Vd2) - (Vs1 - Vd1),$$

Vd1 is a voltage applied to said toner carrying member by said voltage applying device during a period in which the latent image is visualized, Vs1 is a voltage applied to said toner supplying member during the period, vd2 is a voltage applied to said toner carrying member by said voltage applying device during at least a part of a period which is after application of the voltage Vd1 and before stoppage of rotation of said toner supplying member, and Vs2 is a voltage applied to said toner supplying member during said at least the part of the period.

2. An apparatus according to claim 1, wherein said toner supplying member rotates at least one turn during said at least the part of the period.

3. An apparatus according to claim 1, wherein said controller controls said voltage applying device such that Vs3−Vd3 has a polarity opposite the regular charging polarity of the toner, where Vd3 is a voltage applied to said toner carrying member by said voltage applying device during at least a part of a period which is after the visualization of the latent image and stoppage of rotation of said toner supplying member and before resumption of rotation of said toner supplying member to visualize the latent image, and Vs3 is a voltage applied to said toner supplying member during said at least the part of the period.

4. An apparatus according to claim 1, further comprising a detecting device for detecting information relating to history of use of said image forming apparatus, wherein said controller changes A in accordance with the information detected by said detecting device.

5. An apparatus according to claim 4, wherein said detecting device detects information relating to a number of rotations of said toner carrying member.

6. An apparatus according to claim 4, wherein said detecting device detects information relating to a drive time of said toner carrying member.

7. An apparatus according to claim 4, wherein said detecting device detects information relating to a number of recording materials on which images have been formed.

8. An apparatus according to claim 1, further comprising a second detecting device for detecting information relating to ambient condition of said image forming apparatus, wherein said controller changes A in accordance with the information detected by said second detecting device.

* * * * *